United States Patent [19]

Reece et al.

[11] 4,137,513

[45] Jan. 30, 1979

[54] MATRIX PRINT WIRE SOLENOID

[75] Inventors: John W. Reece, Sunnyvale, Calif.; Victor J. Italiano, Ithaca; Leslie L. Crump, Trumansburg, both of N.Y.

[73] Assignee: NCR Corporation, Dayton, Ohio

[21] Appl. No.: 846,082

[22] Filed: Oct. 27, 1977

[51] Int. Cl.[2] ..... H01F 7/16

[52] U.S. Cl. ..... 335/219; 335/255; 335/258; 400/124

[58] Field of Search ..... 335/219, 270, 262, 278, 335/255; 400/124

[56] References Cited

U.S. PATENT DOCUMENTS

| | | | |
|---|---|---|---|
| 4,014,425 | 3/1977 | Henricus | 400/124 |
| 4,016,965 | 4/1977 | Wirth | 335/258 |

*Primary Examiner*—Harold Broome

*Attorney, Agent, or Firm*—J. T. Cavender; Wilbert Hawk, Jr.; George J. Muckenthaler

[57] ABSTRACT

A matrix print wire solenoid has a small diameter print wire which wire is propelled against printing paper and inking ribbon by the linear motion of the solenoid plunger, to which the print wire is attached, in an improved impact printer having a plurality of solenoids positioned in a row for use in dot matrix printing. The solenoid features a low cost construction, a reduction in size, and increased operating speed, and has pole pieces which are separated by an inner gap and which pieces are aligned with a coil bobbin which provides a guide surface for the armature plunger. The space between the plunger and a forward bushing or spacer is occupied by a coil spring which has one end seated over a portion of the armature and the other end seated against the face of the bushing. The coil bobbin defines an air gap between one pole piece and the armature.

15 Claims, 2 Drawing Figures

MATRIX PRINT WIRE SOLENOID

BACKGROUND OF THE INVENTION

In the field of wire matrix printers, it has been quite common in the past to provide a print head which has included a plurality of print wire actuators or solenoids arranged or grouped in a manner to drive the print wires a precise distance from a rest or home position to an impact position. The print wires are generally secured to the solenoid plunger which is caused to be moved the precise distance when the solenoid coil is energized, the plunger operating against the action of a return spring.

Representative prior art is shown in U.S. Pat. No. 3,755,700 issued to H. Buschmann et al. on Aug. 28, 1973, which discloses an electromagnetic drive having a pair of pole shoes and an armature guided in the pole shoes wherein the armature consists of two segments, one being a non-magnetic segment which receives one end of a helical spring and the other end of the spring engaging a pin. The pin is provided with a projection which corresponds to the inner diameter of the spring so that the cylindrical form of the spring is maintained during operation by the chamber of the above-mentioned armature segment. This segment also serves as a guiding element which insures that the armature moves freely in the longitudinal direction of the magnet coil.

U.S. Pat. No. 3,787,791 issued to J. H. Borger et al. on Jan. 22, 1974, shows a solenoid having a plunger which is guided along the coil bobbin and which also includes a guide piece for the print wire which is secured to the armature plunger by a swaging operation.

U.S. Pat. No. 3,802,543 issued to R. Howard on Apr. 9, 1974, shows a solenoid which includes a shell housing a coil with a central core portion for receiving a print wire which is secured to one end of an armature and which print wire passes through an opening in the shell. The armature is slidable in a bobbin portion of the coil which portion abuts one end of a central core portion with an air gap between the armature and the central portion.

U.S. Pat. No. 3,897,865 issued to D. P. Darwin et al. on Aug. 5, 1975, discloses a solenoid for driving a print wire through an aperture in a fixed pole piece and which wire is attached to a movable armature. The armature and the pole piece are disposed in the aperture of the coil which is wound about a bobbin and wherein the hollow inner portion forms a core or working gap of the solenoid drive system. A compression return spring is mounted in a recess or counter bore of the fixed pole piece and the spring is under compression with the pole piece held in place under a force or friction fit in the armature. The clearance of the armature allows it to slide freely in the inner core of the bobbin and the armature is held in place by a stop member.

U.S. Pat. No. 3,900,094 issued to R. B. Larson et al. on Aug. 19, 1975, shows a solenoid actuator assembly which has an armature secured to the print wire and disposed for slidable axial reciprocation within a cylindrical bearing between a front stop and a rear stop. The coils are each insulated by a plastic bobbin. The front stop is of hollow configuration to provide a central bore and a reduced end portion which end portion is provided with a flared extremity surrounding the end of the bore.

U.S. Pat. No. 4,004,671 issued to N. Kondur, Jr. on Jan. 25, 1977, discloses a solenoid with a drive coil wound on a bobbin or spool and a front pole piece is inserted into one end of a tube and has an enlarged flange which is interposed between a nose portion and the spool and a central bore in the front pole piece is aligned with a central opening in the nose portion. The second pole piece is interposed between the spool and a stop which has a sleeve sized to receive a return spring in surrounding relation to the armature.

And, U.S. Pat. No. 4,016,965 issued to R. L. Wirth et al. on Apr. 12, 1977, shows a solenoid which includes a stationary pole piece and a movable plunger with one end of the plunger being flanged so that the surface of the housing functions as a pole piece for one end of the plunger. The stationary pole piece is pressed into the end of the housing after the bobbin with coil windings is placed inside the housing. The end of the plunger performs two functions of providing a seat for the return spring and also a flux path from the air gap to the plunger.

SUMMARY OF THE INVENTION

The present invention relates generally to impact printing devices for dot matrix printing wherein at least one print wire is propelled against a printing medium by an associated plunger type solenoid print wire driver for printing dot matrix characters in accordance with external control signals which cause plunger coil energization and character printing. More particularly, the present invention relates to an improved print wire solenoid of the hollow core design which includes a bushing member that provides a seat for the return spring and also a guide for the print wire. Additionally, the bobbin has an internal shoulder serving to correctly space the assembly with a minimum of parts, and the bobbin has pilotage at each end with the respective poles so as to provide guidance for the solenoid plunger in a manner which is concentric to the poles.

The present invention comprises a plunger-type tubular solenoid for driving the wire element of an impact printer for dot matrix printing in an arrangement wherein a plurality of solenoids are spaced from each other and aligned across the printer for printing in a manner wherein the solenoids are caused to be driven back and forth across the machine and printing a line of dots at a time. The coil bobbin serves as a guide for the armature or plunger and also serves as a pilot and end stop for one pole piece which is the core of the solenoid. The return spring is nested within the cavity in the core of the solenoid, one end of the spring being seated on a bushing which serves as a wire guide and the other end being seated on one end portion of the armature or plunger of the solenoid. The other pole piece provides an annular shoulder to seat the bobbin and serves as a flange for the bobbin of which it becomes an integral member. A cap is provided for one end of the solenoid. The first mentioned pole piece which provides for the print wire guide, includes an annular groove in the flange portion of the pole piece which serves as a locating shoulder for the housing sleeve. This first pole piece includes a seat for the wire guide bushing and is itself seated on the shoulder of the bobbin which structure controls the initial air gap and the preset of the return spring.

In accordance with the above discussion, the principal object of the present invention is to provide an improved wire printer having a plurality of high-speed matrix print wire solenoids.

Another object of the present invention is to provide a print wire solenoid of low cost, reduced diameter, reduced mass, reduced power requirement, reduced heating and increased operating speed over the present tubular solenoids.

A further object of the present invention is to provide a return spring stop which is inside the core while eliminating the expense of a small diameter hole in the core.

An additional object of the present invention is to minimize the mass of the plunger or armature while locating the air gap a distance beyond the center of the bobbin coil.

Additional advantages and features of the present invention will become apparent and fully understood from a reading of the following description taken together with the annexed drawing.

DESCRIPTION OF THE PREFERRED EMBODIMENT

Figure 1:
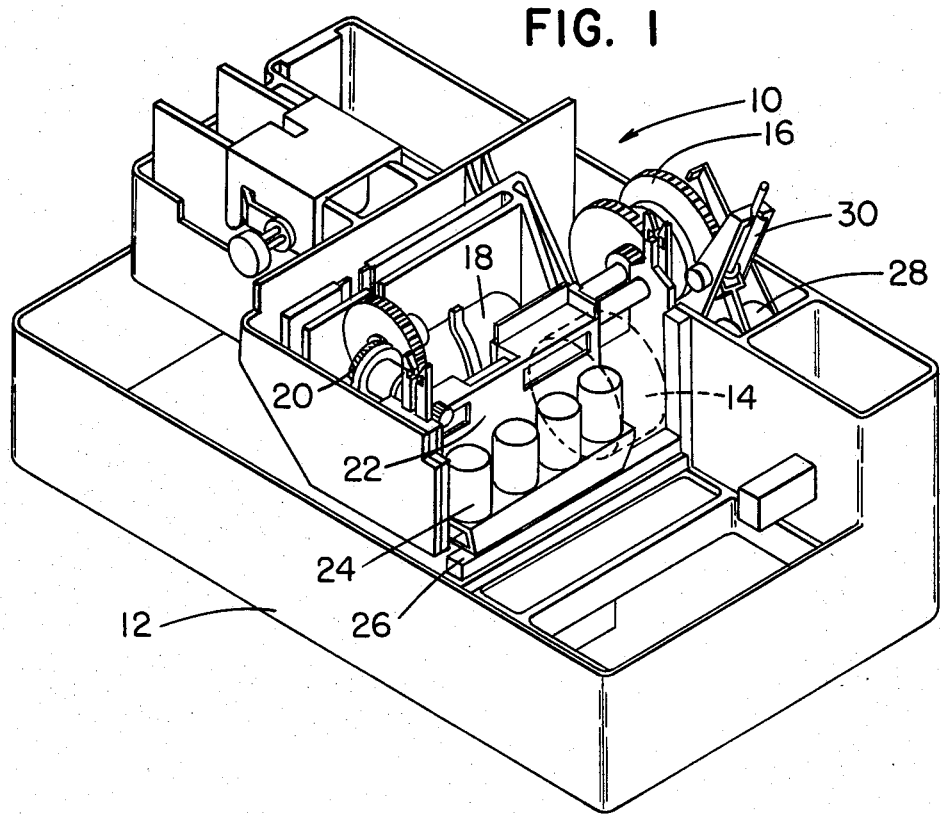
FIG. 1 is a left front perspective view of a matrix printer incorporating the subject matter of the present invention.

Referring now to FIG. 1, there is shown a printer of the matrix type generally designated as 10, the top cover or portion thereof being removed to illustrate certain of the interior working parts which are contained within an enclosure 12 which assumes a rectangular shape and provides protection for a compact, high speed printer. A drive motor 14 is positioned to drive a cluster of gears 16, a drum cam 18, and a bevel gear 20 for driving a ribbon in continuous manner past the printing station. The drum cam 18 is continuously driven and provides side-to-side drive or movement for a print carriage 22 which carries a plurality of printing solenoids 24 for printing in a dot matrix manner on printing paper or like form which is caused to be moved across a platen 26, such platen being in the shape of a flat bar disposed laterally across the printer. The printing solenoids 24 are caused to be moved a distance of approximately 0.6–0.7 inch during the printing operation which includes printing in each direction of movement of the printing carriage 22. At the end of each line of printing, the paper is caused to be moved by an incremental dot feed arm 28 wherein, in the case of a seven dot height matrix character, the feed arm will advance the paper a total of seven times to complete a line of character printing. A line feed arm 30 provides for advancing the printing paper at a line-to-line spacing which would advance the paper for the next line of characters.

Figure 2:
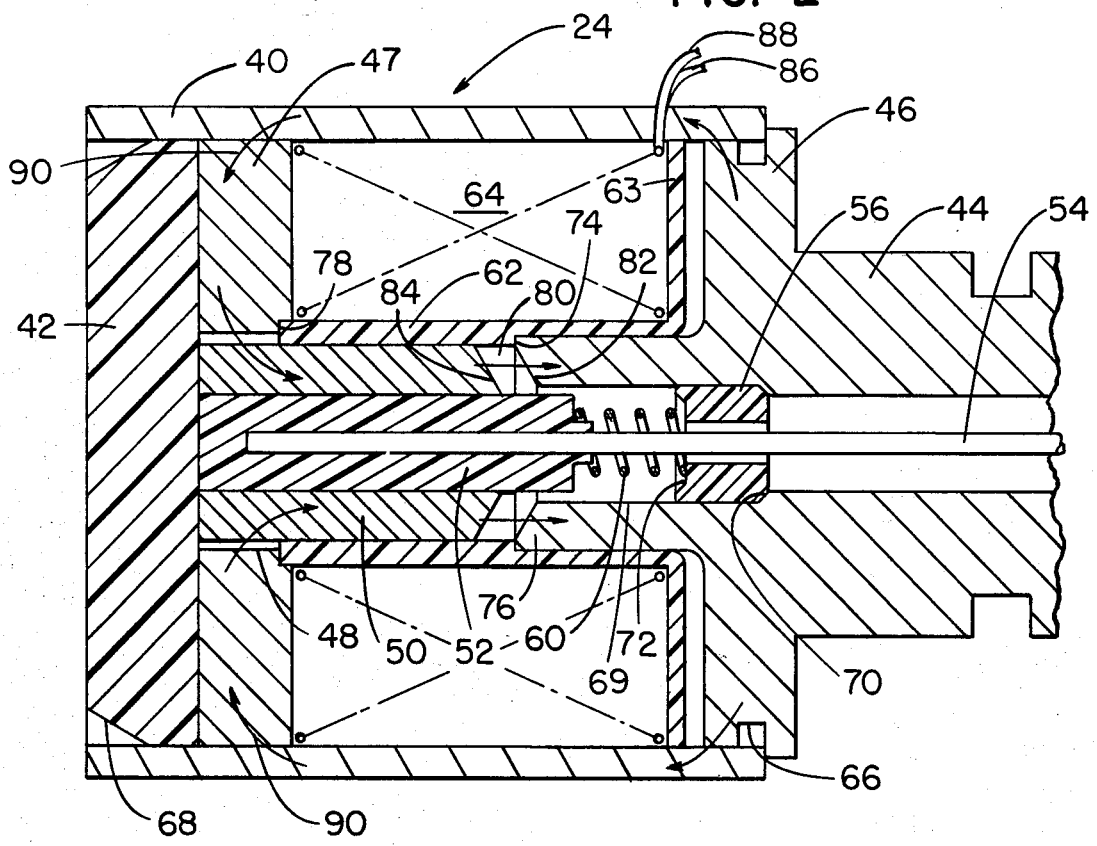
FIG. 2 is a sectional view of a solenoid for illustrating certain features of the present invention in greater detail.

Referring now to FIG. 2 which shows a sectional view of one of the printing solenoids 24, such solenoid includes an outer housing 40 of cylindrical shape, enclosed at one end by a circular cap 42 and enclosed at the other end thereof by a core or lower pole piece 44 having an aperture therethrough and which pole piece includes a flange portion 46 of circular form for closing the lower end of the solenoid. The right hand end of the solenoid shown in FIG. 2 would be the lower portion or the downwardly extending portion of the solenoid 24 shown in FIG. 1, with the print wire being actuated to strike against the paper and the platen 26. An upper pole piece in the form of a disc 47 lies adjacent the cap 42 and includes an aperture 48 therein for receipt of an armature or plunger shell 50 which encloses an armature or plunger core 52 to which is secured a print wire 54. A bushing 56 is contained by a shoulder in the pole piece 44, such bushing providing for receipt of the print wire 54 therethrough. The bushing 56 also provides a seat for a return spring 60 which is utilized to return the armature core 52 to the home position, it being seen that the spring 60 is seated at one end in a recess of the bushing 56 and is seated at the other end over a nose portion of the armature core 52. A bobbin 62 in the form of a sleeve having a flange 63 is provided for containing the coil wires which are wound in the space designated 64, with the bobbin 62 being contained at one end by seating against the upper pole piece 47 and at the other end by a cut out or counter bored portion of the bobbin providing a seat for the lower pole piece 44. The flange portion 46 of the pole piece 44 has an annular groove 66 therein for use in crimping the shell 40 to provide a secure fit of the parts at assembly. The cap 42 also includes a beveled portion 68 therein for crimping of the shell 40 at assembly of the solenoid 24.

It is thus seen that the bobbin 62 design provides a guide for the plunger or armature and is the central locator for the internal magnetic elements, which elements are the plunger shell 50 and the pole pieces 44 and 47. The bobbin 62 causes the plunger to be located concentric to the poles and the internal shoulder of the bobbin controls the initial pole/armature gap and the preset force of the spring 60. The spacer 56 provides a stop or seat for the spring 60 which is housed within the hollow core of the solenoid.

The lower pole piece 44 has an enlarged aperture 69 and a shoulder 70 against which the bushing 56 is seated, with the spring 60 being seated in a recessed portion 72 of the bushing. The bobbin 62 is provided with a shoulder 74 for seating against one end portion 76 of the pole piece 44, the bobbin also providing for guiding the armature shell 50 in its movement, when energized, against the resiliency of spring 60. The pole piece 47 is provided with an annular shoulder 78 for one end of the bobbin 62, with the armature core 52 and the bobbin 62 fixing the inner and outer diameters of the inclined or conical air gap 80. The sloping surfaces 82 and 84 of the pole piece 44 and of the armature shell 50, respectively, define the limits of the air gap 80 in the longitudinal direction of the solenoid 24, the surface 82 being axially fixed in relation to the bobbin 62 and to the bushing 56, and the surface 84 being axially movable as the armature core 52 and the shell 50 are moved against the force of the spring 60 upon energization of the coil 64 through lead wires 86 and 88. The direction of the flux path is shown by the arrows 90.

The armature or plunger shell 50 together with the armature or plunger core 52, while being separate parts, are permanently secured together so as to move as one unit with the print wire 54, and are positioned to place the air or working gap 80 past the center of the coil 64, or toward the right in FIG. 2. This design minimizes leakage flux and its effect of adding non-productive flux load and causing a drop in magnetomotive force in the armature core.

Among the new and improved features in the solenoid 24 of the present invention, the bushing 56 as used in the hollow core design provides a precise seat for one end of the spring 60 by reason of the shoulder 70 in the pole piece 44; the bobbin 62 has the internal shoulder 74 for engaging with the end portion of the pole piece 44 for correctly spacing the assembly with a minimum of intervening parts; and the bobbin 62 is piloted at the shoulder 78 to provide guidance for the plunger or armature shell 50 in a manner which is concentric to the poles 44 and 47.

The magnetic parts of the solenoid 24 such as the armature shell 50, the pole piece 44, the pole piece 47, and the housing 40 are made from low carbon steel, preferably annealed, while the spring 60 and the print wire 54 are made from music wire. The armature core 52, the bushing 56, and the cap 42 are made from plastic material, the type of plastic being selected for ability to withstand impact and wear at the several locations in the solenoid. The bobbin 62 may be made of plastic or nylon material because of the requirements for good wear resistance and low friction.

Certain variations of the armature shell 50 may include a flared skirt portion where the upper pole piece 47 is adjacent the armature shell 50 and the cap 42. This variation in design can provide augmented magnetic force with accurate guiding of the armature so as to maintain a precisely uniform air gap in the annular space between the armature 50 and the pole piece 47. Additionally the bobbin 62 could be designed with two flanges or designed without a flange in a "bobbinless" coil structure wherein cement or adhesive is applied to the outer coils during winding to retain the shape of the coil 64. Another variation may include a slight flaring of the end portion of the bushing 56 engaged with the spring 60 to provide a press-fit in the core of the pole piece 44.

It is thus seen that herein shown and described is a tubular solenoid of reduced diameter, less mass, and increased operating capability for use in a matrix printer whereby the solenoids may be aligned in a row across the printing station or may be formed in the nature of a print head having a plurality of solenoids in a circular manner or in a clustered manner as seen in the prior art. The solenoid as shown and described enables the accomplishment of the objects and advantages mentioned above and while one embodiment of the invention has been disclosed herein, variations thereof beyond those herein mentioned may occur to those skilled in the art. It is contemplated that all such variations not departing from the spirit and scope of the invention hereof are to be construed in accordance with the following claims.

What is claimed is:

1. A solenoid for moving a print wire, comprising a housing, a first pole piece enclosing one end of said housing and having an aperture therethrough, a second pole piece enclosing the other end of said housing and having an aperture therethrough, an armature positioned in the aperture of said second pole piece, said print wire being secured to said armature and movable therewith upon movement of said armature, a coil for providing magnetic flux in a path through said housing and said pole pieces to cause axial movement of said armature and said print wire, a sleeve encircling a portion of said armature and a portion of said first pole piece for containing said coil, said sleeve having an enlarged diametral portion engaged by said first pole piece for positioning said first pole piece in axial relation with said armature and providing a gap therebetween, and means connecting said first pole piece and said armature for maintaining said armature in fixed position prior to energization of said coil, for permitting said armature to move along said gap upon energization of said coil, and for returning said armature to said fixed position upon deenergization of said coil.

2. The solenoid of claim 1 wherein said connecting means comprises a coil spring operating in the aperture of said first pole piece and through which said print wire passes.

3. The solenoid of claim 2 wherein said first pole piece includes an enlarged aperture therein and there is provided a bushing member seated in said enlarged aperture and engaged by said coil spring at a fixed plane of said first pole piece.

4. The solenoid of claim 1 wherein said second pole piece includes an annular recess therein for engagement by one end of said sleeve to fix the axial position thereof in relation with said second pole piece.

5. The solenoid of claim 4 wherein said sleeve includes an elongated annular recess at the other end thereof for seating engagement by said first pole piece and said sleeve one end is seated in said annular recess of said second pole piece.

6. The solenoid of claim 1 wherein said armature comprises an inner portion of non-magnetic material and an outer portion of magnetic material.

7. The solenoid of claim 6 wherein said first pole piece and the outer portion of said armature each define a sloping end surface forming said gap therebetween.

8. In a printer having at least one solenoid for driving a print wire for printing characters, said solenoid comprising a coil energizable in response to magnetizing current, an apertured first pole piece adjacent one portion of said coil, an apertured second pole piece adjacent another portion of said coil, an armature positioned between said pole pieces and axially slidable a precise distance to drive said print wire, a bobbin member disposed to engage said pole pieces and containing said coil in a form to provide magnetic flux in a path through said pole pieces and said armature, said bobbin having an enlarged inside diameter portion for engagement by said first pole piece to fix the position thereof in relation to the armature, said second pole piece having an enlarged inside diameter portion for engagement by said bobbin member to fix the distance of said second pole piece from said first pole piece, and means operably associated with said first pole piece and with said armature for maintaining said armature in one position prior to energizing said coil, for permitting said armature to axially move along said bobbin member upon energizing said coil, and for returning said armature to said position after deenergizing said coil.

9. In the printer of claim 8 wherein said operably associated means comprises a coil spring operating in the aperture of said first pole piece and through which said print wire passes.

10. In the printer of claim 9 wherein said first pole piece includes an enlarged aperture therein and there is provided a bushing member seated in said enlarged aperture and engaged by said coil spring at a fixed plane of said first pole piece.

11. In the printer of claim 8 wherein said second pole piece includes an annular recess therein to form a shoulder for engagement by one end of said bobbin member to fix the axial position thereof in relation with said second pole piece.

12. In the printer of claim 11 wherein said bobbin member includes an elongated annular recess at the other end thereof to provide a shoulder for seating engagement by said first pole piece and said bobbin member one end is piloted in said annular recess of said second pole piece.

13. In the printer of claim 10 wherein said coil spring is seated in said bushing member and said armature includes an end portion encircled by said coil spring.

14. In the printer of claim 8 wherein said armature comprises a core portion of non-magnetic material and a shell portion of magnetic material surrounding said core portion.

15. In the printer of claim 14 wherein said first pole piece and the shell portion of said armature each define a conical-shaped end surface spaced from each other and forming a gap therebetween.

* * * * *